US010343806B2

(12) United States Patent
Fagen et al.

(10) Patent No.: US 10,343,806 B2
(45) Date of Patent: Jul. 9, 2019

(54) MECHANISM FOR DISPENSING PILLS FROM AN ARRAY-TYPE PACKAGE

(71) Applicant: MEDIPENSE INC., Montreal (CA)

(72) Inventors: Terry Fagen, Saint-Lazare (CA); Hesham El-Adly, Montreal (CA); Dominic Gagnon-Tremblay, Canton Orford (CA); Marc-Antoine Archambault, Montreal (CA)

(73) Assignee: MEDIPENSE INC., Montreal (CA)

( * ) Notice: Subject to any disclaimer, the term of this patent is extended or adjusted under 35 U.S.C. 154(b) by 301 days.

(21) Appl. No.: 15/324,179

(22) PCT Filed: Jul. 8, 2015

(86) PCT No.: PCT/CA2015/050633
§ 371 (c)(1),
(2) Date: Jan. 5, 2017

(87) PCT Pub. No.: WO2016/004530
PCT Pub. Date: Jan. 14, 2016

(65) Prior Publication Data

US 2017/0197748 A1 Jul. 13, 2017

Related U.S. Application Data

(60) Provisional application No. 62/043,926, filed on Aug. 29, 2014, provisional application No. 62/021,854, filed on Jul. 8, 2014.

(51) Int. Cl.
*B65D 83/04* (2006.01)
*A61J 7/00* (2006.01)
(Continued)

(52) U.S. Cl.
CPC ..... *B65B 69/0033* (2013.01); *A61J 1/035* (2013.01); *A61J 7/0076* (2013.01); *A61J 7/0454* (2015.05);
(Continued)

(58) Field of Classification Search
None
See application file for complete search history.

(56) References Cited

U.S. PATENT DOCUMENTS 4,909,414 A * 3/1990 Heath ..... B65B 69/0033 221/25
5,377,864 A 1/1995 Blechl et al.
(Continued)

FOREIGN PATENT DOCUMENTS

CA 2334950 A1 12/1999
CA 2334950 C 12/2007
(Continued)

OTHER PUBLICATIONS

European Search Report for Application No. 15818249.3, dated Jan. 25, 2018, 7 pages.
(Continued)

*Primary Examiner* — Gene O Crawford
*Assistant Examiner* — Ayodeji T Ojofeitimi
(74) *Attorney, Agent, or Firm* — Lando & Anastasi, LLP

(57) ABSTRACT

A mechanism for dispensing pills from an array-type pill package is provided. The mechanism includes a chassis, a package holder, a cutting mechanism configured to cut a sidewall of an individual container in the array-type pill package, a dispensing mechanism configured to receive and dispense a cut individual container therein; and a control system configured to control a relative position of the cutting mechanism and the package holder along at least two degrees of freedom. A cutting mechanism is also provided.
(Continued)

The cutting mechanism includes a cutter base movably mounted to the chassis, a cutting tool mounted to the cutting base and adapted for cutting a side wall of an individual container adjacent a common top surface of an array-type pill package to entirely detach individual container from the array-type package; and motor operatively to displace the cutting tool along a plane generally tangent to the package holder.

15 Claims, 7 Drawing Sheets

(51) Int. Cl.
*A61J 7/04* (2006.01)
*B65B 69/00* (2006.01)
*A61J 1/03* (2006.01)

(52) U.S. Cl.
CPC ..... *A61J 7/0481* (2013.01); *B65D 83/0472* (2013.01)

(56) References Cited

U.S. PATENT DOCUMENTS

| | | | |
|---|---|---|---|
| 5,571,258 | A | 11/1996 | Pearson |
| 5,657,236 | A | 8/1997 | Conkright |
| 5,788,079 | A | 8/1998 | Bouthiette |
| 5,883,806 | A | 3/1999 | Meador et al. |
| 6,011,999 | A | 1/2000 | Holmes |
| 6,021,623 | A | 2/2000 | Bouthiette |
| 6,023,916 | A | 2/2000 | Bouthiette |
| 6,026,726 | A | 2/2000 | Bouthiette |
| 6,318,051 | B1 | 11/2001 | Preiss |
| 6,338,007 | B1 | 1/2002 | Broadfield et al. |
| 6,471,087 | B1 | 10/2002 | Shusterman |
| 6,510,668 | B2 | 1/2003 | Kim |
| 6,585,132 | B2 | 7/2003 | Kim |
| 6,594,549 | B2 | 7/2003 | Siegel |
| 6,607,094 | B2 | 8/2003 | Macdonald |
| 6,650,964 | B2 | 11/2003 | Spano, Jr. et al. |
| 6,681,935 | B1 | 1/2004 | Lewis |
| 6,805,259 | B2 | 10/2004 | Stevens et al. |
| 6,887,431 | B1 | 5/2005 | Vann et al. |
| 6,961,285 | B2 | 11/2005 | Niemiec et al. |
| 7,139,639 | B2 | 11/2006 | Broussard et al. |
| 7,418,311 | B1 | 8/2008 | Lagassey et al. |
| 7,885,725 | B2 | 2/2011 | Dunn |
| 8,032,252 | B2 | 10/2011 | Berg |
| 8,061,109 | B2 | 11/2011 | Freudelsperger |
| 8,230,662 | B2 | 7/2012 | Boutin |
| 8,326,455 | B2 | 12/2012 | Dunn |
| 8,527,090 | B2 | 9/2013 | Monto et al. |
| 8,733,217 | B2 | 5/2014 | Yuyama et al. |
| 9,400,873 | B2 | 7/2016 | Kamen et al. |
| 2002/0162303 | A1 | 11/2002 | Skrak et al. |
| 2003/0120384 | A1 | 6/2003 | Haitin |
| 2006/0081106 | A1* | 4/2006 | Nishimura ..... B26D 1/08 83/665 |
| 2007/0125212 | A1 | 6/2007 | Hilgendorf |
| 2009/0065525 | A1 | 3/2009 | Shen et al. |
| 2012/0277904 | A1* | 11/2012 | Pritchard ..... G07F 9/02 700/232 |
| 2013/0168405 | A1* | 7/2013 | Yuyama ..... G07F 11/42 221/151 |

FOREIGN PATENT DOCUMENTS

| | | | |
|---|---|---|---|
| JP | H01182231 | A | 7/1989 |
| WO | 2013013108 | A2 | 1/2013 |

OTHER PUBLICATIONS

International Search Report and Written Opinion for International Application No. PCT/CA2015/050633 dated Oct. 14, 2015.
International Search Report and Written Opinion for International Application No. PCT/CA2015/050632 dated Oct. 14, 2015.

* cited by examiner

MECHANISM FOR DISPENSING PILLS FROM AN ARRAY-TYPE PACKAGE

RELATED PATENT APPLICATIONS

The present application is a U.S. National Stage Application under 35 U.S.C. § 371 of PCT Application Serial No. PCT/CA2015/050633, filed on Jul. 8, 2015, which claims priority from U.S. provisional patent application No. 62/021,854 entitled MECHANISM FOR DISPENSING OBJECTS FROM AN ARRAY-TPE PACKAGE INTO ORIGINAL CONTAINERS THEREOF, and from U.S. provisional patent application No. 62/043,926 entitled CUTTING MECHANISM IN A DISPENSER FOR ARRAY-TYPE PACKAGES, the contents of which are each incorporated herein by reference.

TECHNICAL FIELD

The present invention relates to dispensers, and more specifically to a mechanism for dispensing objects from an array-type package inside individual containers thereof, and to a cutting mechanism for cutting individual containers of the array-type package.

BACKGROUND

There are many types of food objects, goods or pellets packages provided with a plurality of independent or individual small containers connected to one another at a common top surface thereof. Each individual container contains a predetermined quantity and/or selection of objects, pellets or goods such as, but not limited to, medications, pills, vitamins, candies, coffee beans, tea, seeds or the like. More specifically, when used with medication pills, each set of a predetermined individual container needs to be taken a specific day, and at a predetermined time by the patient. These type of packages are usually prepared in advance by a pharmacist or other health professional and it is the responsibility of the patient to take each set of pills, or a caregiver thereof (as a relative, spouse, visiting health professional, etc.), to administer each set of pills at the right time, the right day, and not to make any mistake on the specific individual container it is time to open.

Accordingly, there is a need for getting the content of any individual container at any time, irrespective of the location of the container within the array. Even manually, such an operation often gets difficult, considering the fact that such array-type packages are usually made out of a common top surface typically made out of coated paper or the like material covering the containers typically made out of plastic (PVC—polyvinyl chloride) material or the like. First, the patient needs to properly locate the individual container among the multiple containers, and typically tear it off from the package. Second, to access the pills of the specific individual container, the patient typically needs to either peel off or perforate the top cover of the container using a sharp tool or the like. Known dispensers are not capable of dispensing the content of any selected individual container within an array, especially not dispensing the content into its original container.

Accordingly, there is a need for an improved cutting mechanism for selectively dispensing pea-size objects, pills or the like from individual containers of an array-type package.

SUMMARY

According to an aspect, a mechanism for dispensing pills in an individual container is provided, the individual container being one of a plurality of individual containers in an array-type pill package in which the individual containers are attached to one another in an arrangement of rows and columns and have a common top surface, the plurality of individual containers extending from the common top surface on a same side thereof. The mechanism includes: a chassis; a package holder supported by the chassis for supporting the array-type pill package; a cutting mechanism supported by the chassis and configured to cut a sidewall of the individual container adjacent the common top surface in order to separate the individual container from the array-type pill package; a dispensing mechanism supported by the chassis and configured to receive and dispense a cut individual container therein; and a control system operatively connected to at least one of the package holder and the cutting mechanism, the control system being configured to control a relative position of the cutting mechanism and the package holder along at least two degrees of freedom.

In an embodiment, the package holder and the cutting mechanism are movably mounted to the chassis and the control system is configured to control the relative position of the package holder and the cutting mechanism along a first of the at least two degrees of freedom by displacing the package, and along a second of the at least two degrees of freedom by displacing the cutting mechanism.

In an embodiment, the control system includes a first motor configured to displace the package holder along the first degree of freedom, and a second motor configured to displace the cutting mechanism along the second degree of freedom.

In an embodiment, the package holder has a cylindrical shape with a periphery and a longitudinal axis, the first motor being configured to rotate the package holder about the longitudinal axis, and the second motor being configured to actuate the cutting mechanism in a plane generally tangent to the periphery of the package holder.

In an embodiment, the second motor is configured to actuate the cutting mechanism along a displacement axis in the plane generally tangent to the periphery of the package holder, the displacement axis being generally parallel to the longitudinal axis of the package holder.

In an embodiment, the dispensing mechanism includes a guiding slide and a dispensing tray, the guiding slide being configured to receive the cut individual container and displace it towards the dispensing tray.

In an embodiment, the guiding slide and dispensing tray are operatively connected to the cutting mechanism and displaceable therewith along the displacement axis.

In an embodiment, the periphery of the package holder includes an axial zone without any individual containers, said axial zone being sized to allow the cutting mechanism to displace therealong without contacting any of the individual containers.

According to an aspect, a cutting mechanism for opening and releasing a selected individual container from an array-type pill package is provided, the individual container being one of a plurality of individual containers in the array-type pill package attached to one another and having a common top surface, the plurality of individual containers extending from the common top surface on a same side thereof, the array-type package being mounted onto a package holder supported by a chassis. The cutting mechanism includes: a cutter base movably mounted to the chassis and displaceable relative to the package holder; a cutting tool mounted to the cutting base, the cutting tool being adapted for cutting a side wall of the selected individual container adjacent the common top surface to entirely detach the predetermined individual container from the array-type package; and a cutter motor operatively connected to the cutter base configured to displace the cutting tool in a plane generally tangent to the package holder.

In an embodiment, the cutting mechanism further includes a controller system configured to control a displacement of the cutting tool relative to the package holder along a displacement axis in the plane generally tangent to the package holder.

In an embodiment, the cutting tool includes a cutting blade extending transversely relative to the displacement axis.

In an embodiment, the cutting tool has a transverse length chosen such that the cutting blade simultaneously intersects with opposite side walls of the selected individual container upon displacement of the cutting tool along the displacement axis.

In an embodiment, the cutting blade has a width chosen such that the cutting blade fits within a smallest space between two adjacent individual containers in the array-type pill package.

In an embodiment, the cutting tool is rotatable relative to the cutter base.

In an embodiment, the cutting mechanism further includes a cutter vibration motor operatively connected to the cutter base configured to vibrate the cutting blade transversely.

In an embodiment, the cutting mechanism further includes a worm screw operatively connected to the cutter motor and meshing with a threaded bore extending through the cutter base, the worm screw extending along the displacement axis.

In an embodiment, the cutting mechanism further includes a cutter guide mounted to the chassis and generally parallel to the worm screw, the cutter guide slidably guiding the cutter base therealong.

In an embodiment, the controller system includes limit switches defining first and second end positions of the cutter base along the displacement axis.

In an embodiment, the cutter base includes a dispensing tray below the cutting tool, the dispensing tray being configured to receive the selected individual container after being cut from the array-type package.

According to an aspect, a method for dispensing pills from a selected individual container of a plurality of individual containers of an array-type pill package is provided, the individual containers being attached to one another in an arrangement of rows and columns and having a common top surface, the array-type pill package being mounted in a dispensing system including a chassis, a cylindrical package holder mounted on the chassis rotatably about a longitudinal axis thereof and holding the array-type pill package thereon with the individual containers projecting radially away from said cylindrical package holder, and a cutting mechanism movably mounted to the chassis and displaceable along a displacement axis tangent to the cylindrical package holder. The method includes the steps of: a) rotating the package holder to align an axial zone of the package holder without any individual containers with the cutting mechanism; b) positioning the cutting mechanism along the displacement axis between a column or row of individual containers adjacent the selected container; c) rotating the package holder to position the cutting mechanism adjacent the selected container; d) actuating the cutting mechanism along the displacement axis so as to cut through the sidewalls of the selected container; e) receiving the cut selected container in a dispensing tray connected to the cutting mechanism; f) positioning the cutting mechanism along the displacement axis between a second column or row of individual containers; g) rotating the package holder to align the axial zone of the package holder without any individual containers with the cutting mechanism; and h) actuating the cutting mechanism to displace the dispensing tray to an exterior of the chassis, thereby dispensing the pills while inside the selected individual container.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION

Figure 1:
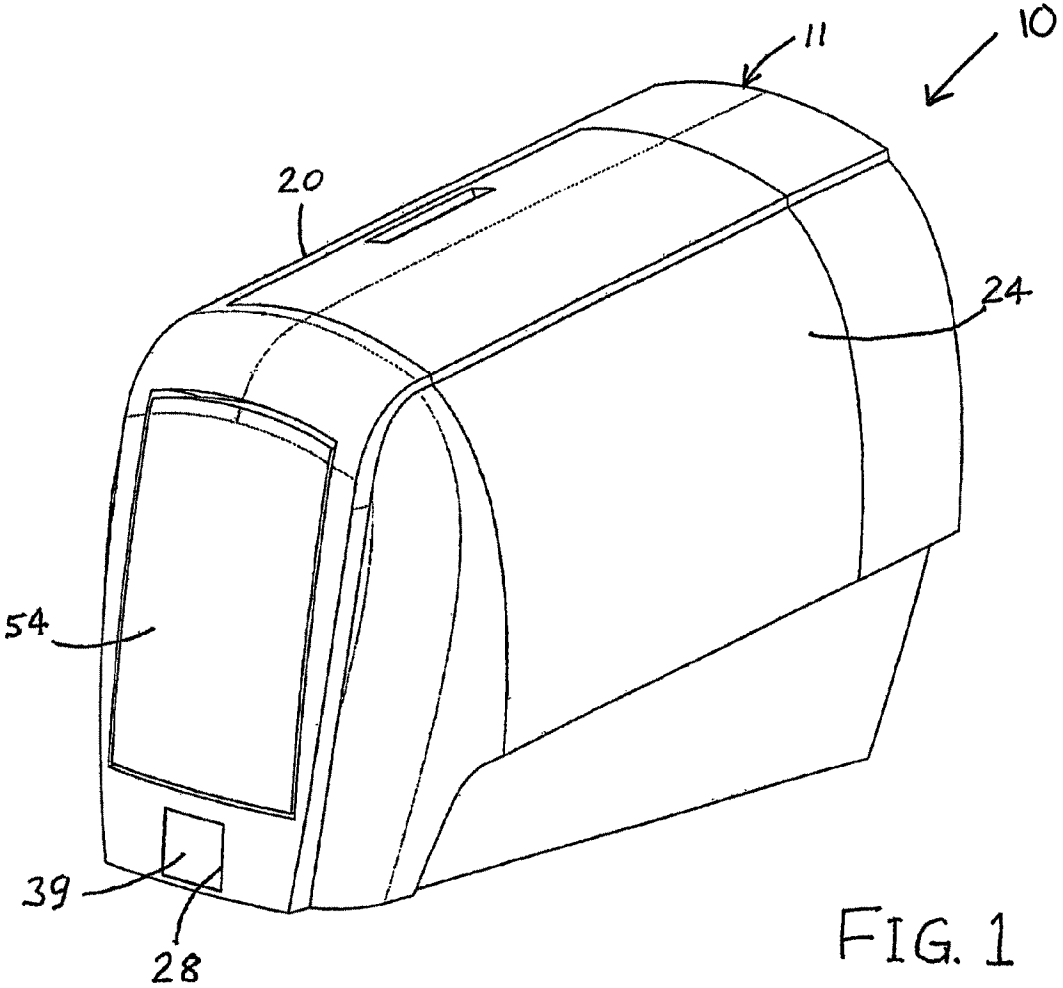
FIG. 1 is a simplified top perspective view of a dispenser for array-type pill packages having individual containers, the dispenser having a cutting mechanism for selectively dispensing objects from the array-type package while inside the individual containers in accordance with an embodiment.

With reference to the annexed drawings the preferred embodiment of the present invention will be herein described for indicative purpose and by no means as of limitation.

Referring to FIGS. 1 through 6, there is shown a dispenser 11 for array-type packages 12 having individual containers 14, according to an embodiment. The dispenser comprises a mechanism 10 for dispensing objects from an array-type package 12 while inside the individual containers 14.

Figure 5:
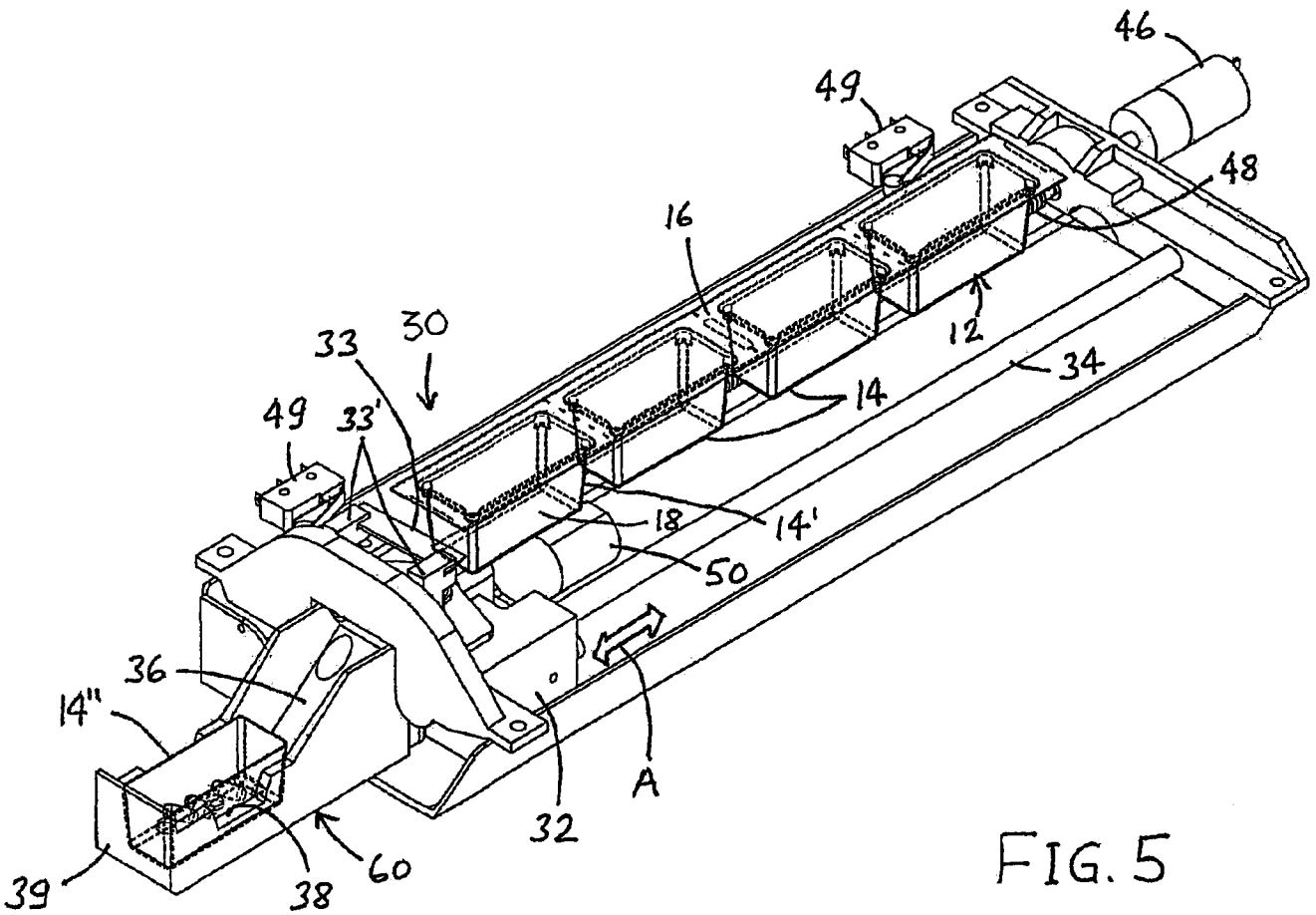
FIGS. 5 and 6 are partially broken enlarged front and rear perspective views, showing the cutting mechanism and the dispensing mechanism.

Although the term pill is used throughout the following description, one skilled in the art would readily understand that the present invention is not limited to the dispensing of medication pills (not shown), but also encompasses the dispensing of any type of objects, and preferably pea-size (small) objects, goods or pellets (such as candies, coffee, tea, seeds or the like) contained in individual containers 14 of the array-type package 12, as shown in dotted lines in the dispensed container 14" of FIG. 5.

The individual containers of the array-type pill package 12 are typically attached to one another in an arrangement of rows and columns and having a common top surface 16. The common top surface 16 is generally flexible and has all of the individual containers 14 extending therefrom on a side thereof. Although seven rows and four columns are shown in the example illustrated in FIG. 3, it will be readily understood that in other variants a different number of rows and column may be provided. The common top surface 16 may for example be made of coated paper material, foil, plastic or the like, such as materials typically used for blister packaged medications or gum. The individual containers are typically made out of plastic materials such as PVC or Polypropylene. Other materials could be considered, such as for example corn-type cellulose, cardboard, etc. In the medical example, each individual container 14 typically contains a plurality of pills, all of them to be taken by the patient at a same time, according to a predetermined scheme based on the instructions of the health professional(s)—namely patient's doctor, dentist, pharmacist or the like. The dispenser 11 may for example be operated to dispense the pills according to at least some of the features of international application PCT/CA2015/050591 filed on Jun. 25, 2015 and entitled "SYSTEM AND METHOD FOR THE DISPENSING OF PILLS", the entire contents of which are incorporated herein by reference.

The dispenser 11 has a main chassis 20 supporting all the other components of the dispenser. A package holder 22 is mounted on the chassis 20 and typically rotates about its longitudinal axis 23 relative to the chassis 20. The holder 22 typically receives and supports at least one, preferably two packages 12 thereon, such that one package can be removed and replaced with another one while the other package is installed to allow a timely dispensing of the pills (not shown) therefrom to the patient.

The dispensing mechanism 10 includes a cutting mechanism 30 operatively connected to the chassis 20 for cutting a side wall 18 of a selected one of the individual containers 14'. Preferably, the side wall 18 is cut adjacent the top wall 16 using a cutting tool 33 mounted to a cutter base 32. In this fashion, the selected individual container 14' can be entirely detached from the array-type package 12, with the pills remaining inside the original container 14'. A controller system 40 controls a displacement of the cutter base 32 relative to the package holder 22 and the pill package 12. Preferably, the displacement is along at least two degrees of freedom, and can be a two-axis (planar) displacement for example. In this fashion, the controller system 40 can position the cutter base 32 adjacent the selected individual container 14'. In order to achieve a relative displacement of the cutter base 32, the controller system 40 can displace at least one of the cutting tool 33 and the package holder 22 relative to the chassis 20. A dispensing member 60 is operatively connected to the chassis 20 to receive and dispense the cut selected individual container 14'.

Figure 2:
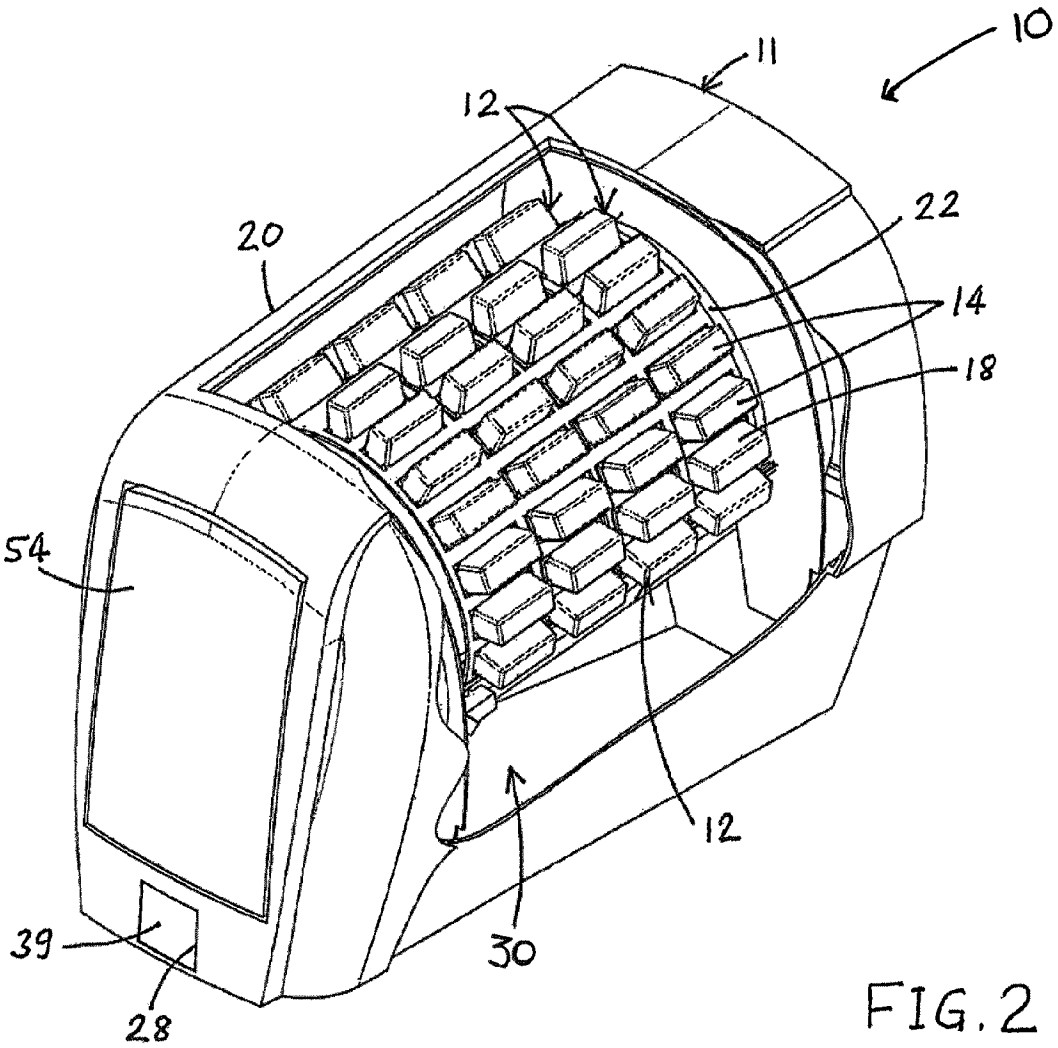
FIG. 2 is a partially broken top perspective view of the embodiment of FIG. 1, showing a cylindrical package holder.
Figure 4:
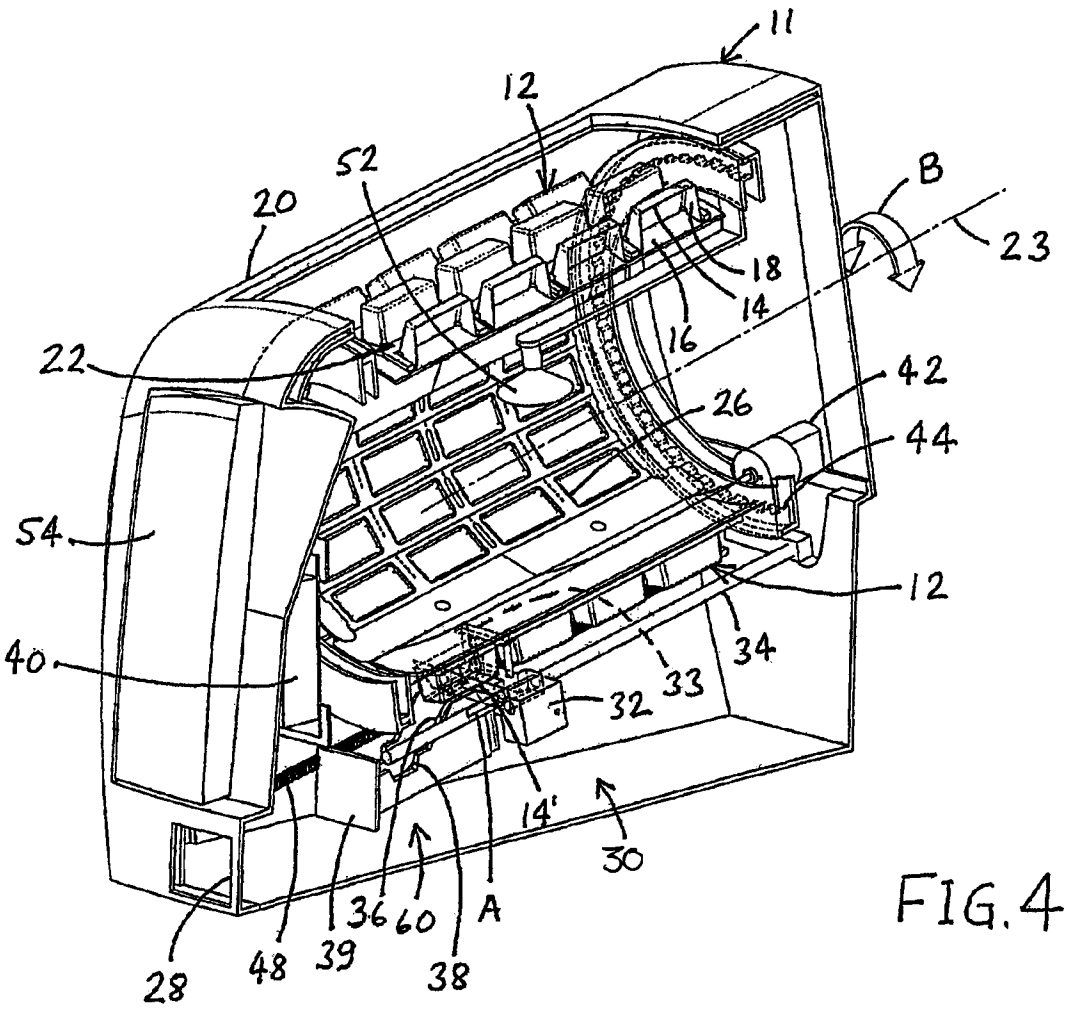
FIG. 4 is a partially broken perspective view of the embodiment of FIG. 1, showing a cutting mechanism and a dispensing mechanism.

In the present embodiment, the holder 22, being typically cylindrical in shape, is typically movably mounted onto the chassis 20 to rotate about its longitudinal axis 23, and thereby as indicated by arrow B in FIG. 4. The holder 22 also typically removably supports the two array-type packages 12 around its cylindrical periphery with the different rows of containers 14 being each oriented generally concentric with the longitudinal axis 23 and spaced from one another around the periphery of the holder 22. As shown in FIG. 2, the holder 22, reachable via a body cover 24, generally clamps the top wall 16 of the package 12 on its periphery to secure the package there against. To ensure proper orientation and alignment of the package 14 relative to the holder 22, a registering mechanism can be provided. For example, openings 26 can be provided in the package holder 22 for tightly fitting around the individual containers 14.

Figure 6:
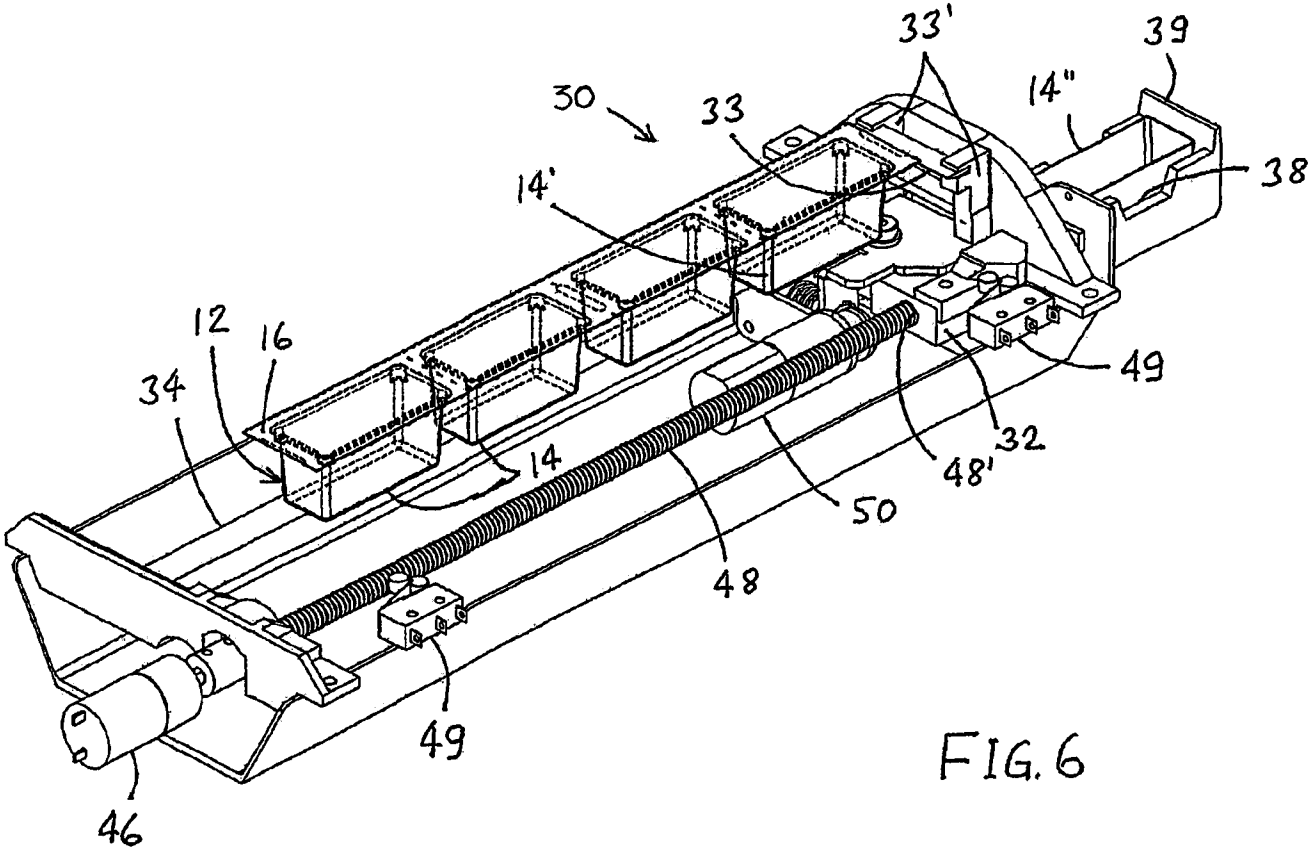
Figure 7:
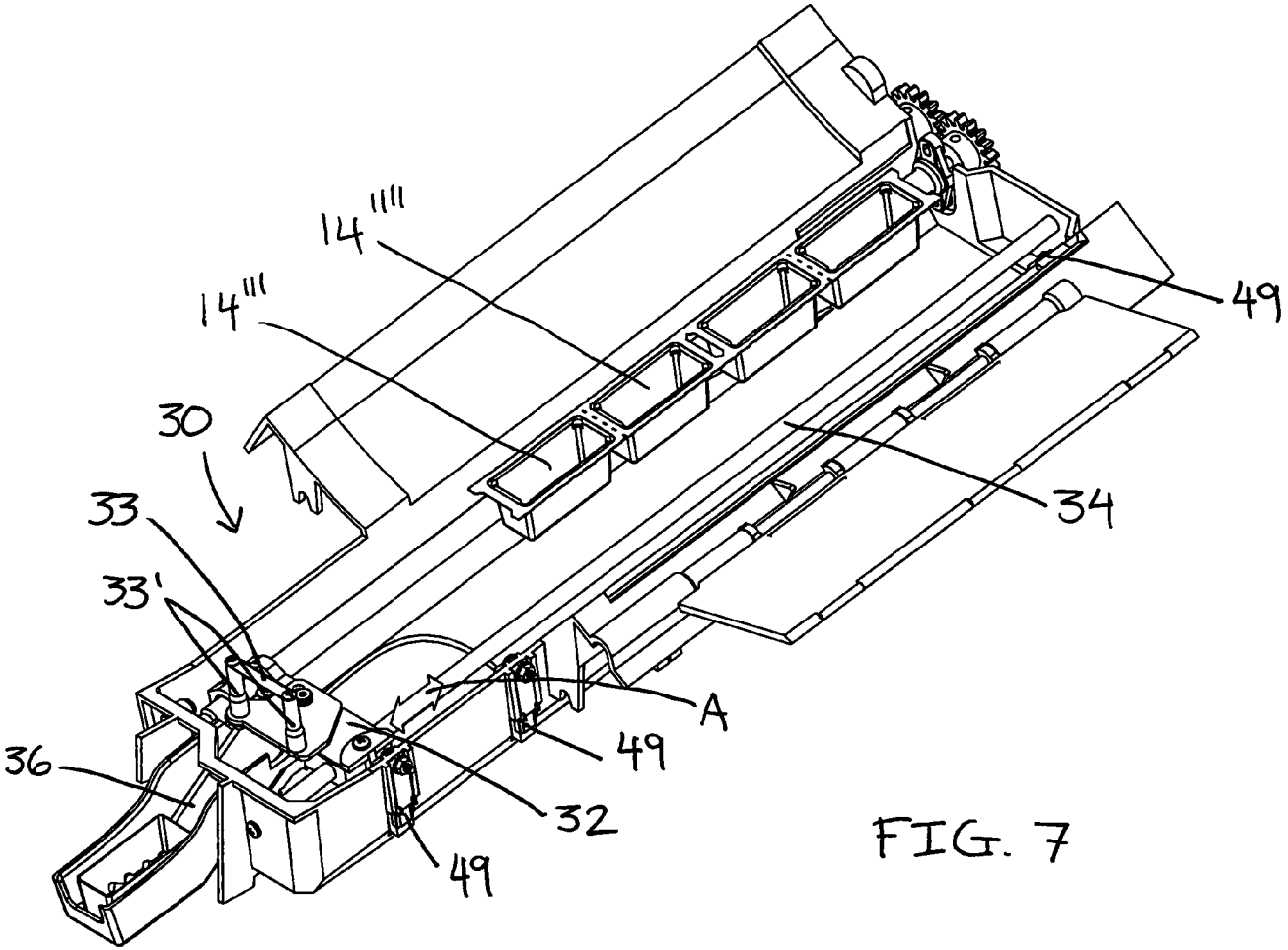
FIG. 7 is a partially broken enlarged front perspective view of a cutting mechanism and a dispensing mechanism according to an alternate embodiment.

The cutting mechanism 30 typically includes a cutter base 32 supporting on posts 33' the cutting tool 33. In the illustrated embodiment, the cutting tool 33 is a sharp cutting blade adapted to entirely cut through the side wall 18 of a selected container 14' adjacent the top wall 16. The cutting tool 33 and at least the upper portions of posts 33' are adapted to fit into the smallest space between two adjacent containers 14 of adjacent columns. Any other cutting tool can be considered without departing from the scope of the present invention, such as, but not limited to, a laser beam, a heated wire, etc. The cutter base 32 typically moves along a first axis A, or displacement axis, of the chassis 20, typically linearly, preferably rectilinearly, along a cutter guide 34, as a guiding rod or the like, mounted to the chassis 20 and oriented generally parallel to the longitudinal axis 23, as seen in FIGS. 4 to 6. In some embodiments, such as illustrated in FIG. 7, the cutting tool 33 can be rotatable relative to the cutter base 32, that is, about the first axis A. In such embodiments, the cutting tool 33 can be controlled to rotate to fit between adjacent containers 14 to aid in positioning the cutting tool 33 relative to the containers 14, and for example skipping a container 14''' in a row to cut a selected container 14''''. The cutting tool 33 can also be rotated to cut the container at an angle.

Referring back to FIGS. 4 to 6, in the illustrated embodiment the controller system 40 is electrically connected to a holder motor 42 to control the rotation of the holder 22, and the package(s) 12, around the longitudinal axis 23. The holder motor 42 is typically connected to a gear train and/or sprocket 44 or the like mounted between the main chassis 20 and the holder 22. The controller system 40 is also electrically connected to a cutter motor 46 typically meshing with a worm screw 48 or the like for rotation thereof and linear displacement of the cutter base 32 along the axis A, between first and second limit switches 49. In the present embodiment, the limit switches 49 are embodied by mechanical switches which define the displacement range of the cutter base 32. In an alternate embodiment however, as illustrated in FIG. 7, the limit switches 49 may include optical photogates. In other variants, the limit switches may also be provided at several critical points along the axis A in the displacement of the cutter base 32. For example, as illustrated, limit switches 49 can be provided at the beginning and end of the displacement range, and also at point in between, for example to define a parking area for the cutter base 32.

Referring still to FIGS. 4 to 6, the worm screw 48 meshes with a threaded bore 48' extending through the cutter base 32. Accordingly, in the present embodiment, the controller system 40 controls the displacement of the package holder 22 and the array-type package 12 relative to the chassis 20 in a first degree of freedom around the longitudinal axis 23. The controller system 40 also controls a displacement of the cutter base 32 relative to the chassis 20 in a second degree of freedom along the first axis A. In this fashion, the cutter base 32 (and thus the cutting tool 33) and the array-type package 12 are displaceable relative to each other along two degrees of freedom: a rotational displacement, and a longitudinal displacement. In alternate embodiments, additional degrees of freedom can be provided to aid in positioning the cutting tool 33 relative to the package 12. For example, in the embodiment shown in FIG. 7, the cutting tool 33 is rotatable relative to the cutter base 32, thus providing an additional degree of freedom for positioning the cutting tool 33 relative to the package 12.

Typically, the controller system 40 is also electrically connected to a cutting vibration motor 50 connected to the cutter base 32 to transversally vibrate the cutting tool 33 at the beginning of the cutting operation and facilitate the penetration of the cutting tool 33 into the plastic side wall 18.

Figure 3:
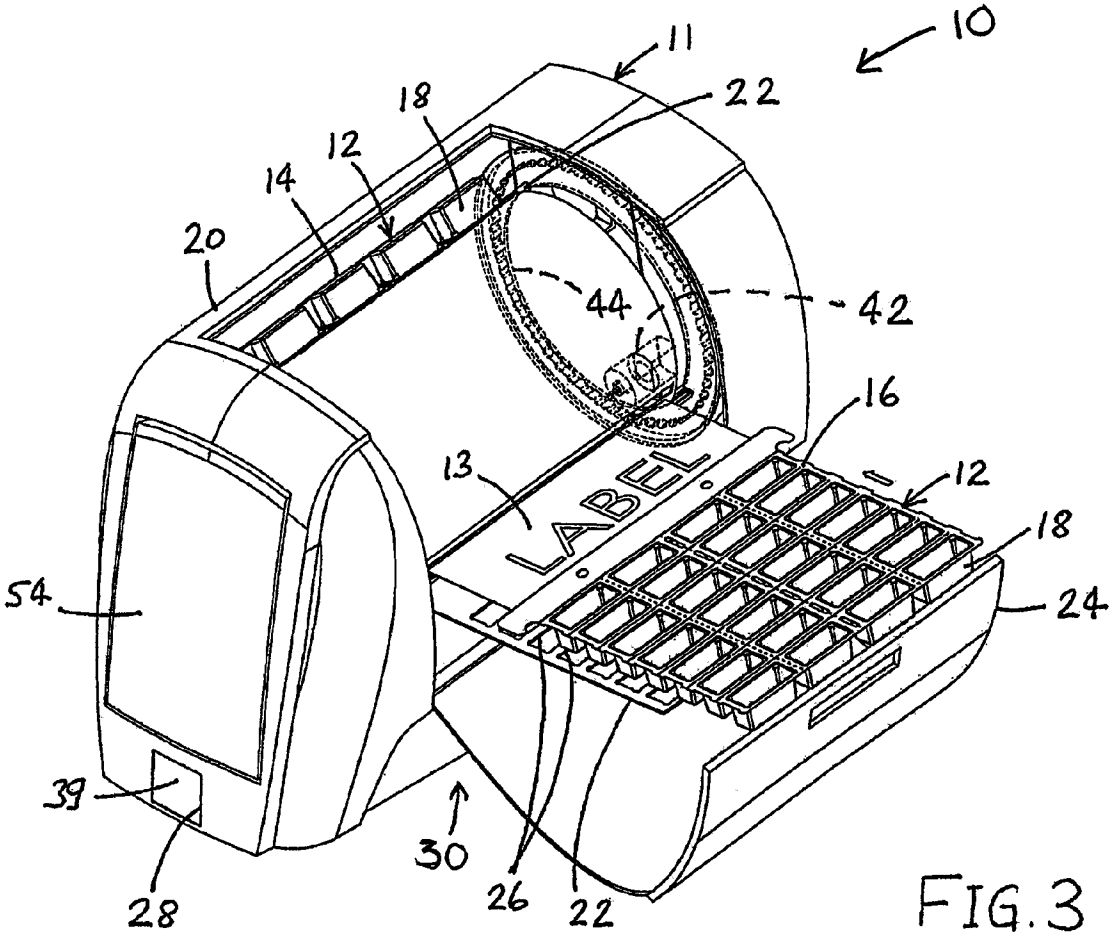
FIG. 3 is an exploded view similar to FIG. 2, showing the cylindrical package holder opened for array-type pill package installation or removal.

In some implementations, the cutter base 32 may include a dispensing member 60 typically including a guiding slide 36 adapted to receive the cut individual container 14' (with the pills therein) falling thereon. The cutter base 32 may also include a dispensing tray 38, typically located at the front of the cutter base 32 just behind the cutting tool 33, to receive the cut container 14' sliding from the guiding slide 36 for the selective extraction and dispensing of the pills located into a selected individual container 14'. The guiding slide 36 typically slopes downward towards the dispensing tray 38. To ensure that the cut container 14' actually reaches the dispensing tray 64 without being stuck on its way, a sweeper arm (not shown) or the like can be connected to the cutter base 32 for pushing the cut container 14' down to the dispensing tray 38. The sweeper arm or the like may also be activated periodically, at predetermined time intervals, as a cleaning mechanism, to ensure that the guiding slide 36 is free of any object, contamination or debris that could prevent the next cut container 14 from being properly dispensed. After the predetermined container 14' has been cut and then received into the dispensing tray 38 or receptacle, the cutter motor 46 moves the cutter base 32 towards the front of the chassis 20 with the dispensing tray 38 extending through a dispensing opening 28 formed into the front wall 29 of the chassis 20 to dispense the container 14' to the user, as shown in FIGS. 5-6. When not in use, the cutter motor 46 position the dispensing tray 38 into a rest location with a front wall 39 of the dispensing tray 38 substantially closing off the dispensing opening 28 (as shown in FIGS. 1-3).

In the present embodiment, the controller system 40 rotates the package holder 22 about longitudinal axis 23 to properly align the cutter base 32 with an axial zone of the holder periphery without any individual containers 14, to then allow the cutter base 32 to move about the first axis A at a predetermined position adjacent the column of the package 12 containing the selected container 14'. The controller system 40 then rotates again the package holder 22 about longitudinal axis 23 to properly align the row containing the selected container 14' with the cutter base 32 (as illustrated in FIG. 5). Then the controller system 40 actuates the cutter base 32 toward the container 14' to cut it off from the package 12 and allow it to fall into the tray 38 for dispensing of the pills contained therein (as illustrated in FIG. 4). Since the dispensing tray 38 is preferably secured to the cutter base 32, the holder 22 is rotated again to ensure that the cutter base 32 is free to be displaced without interfering with any of the remaining containers 14. The controller system 40 can then rotate the package holder 22 again about longitudinal axis 23 to re-align the cutter base 32 with the axial zone of the holder periphery without any individual container 14. Finally, the controller system 40 actuates the cutter base 32 to ensure the proper dispensing of the cut container 14' (as shown before being cut, as item 14', in its position in the package 12 and after being cut, as item 14", into the dispensing tray 38 in FIG. 5). In an embodiment, such as the one illustrated in FIG. 7, if an additional degree of freedom is provided, some of the steps of rotating the package holder 22 to align the package holder 22 and containers 14 with the cutter base 32 and cutting tool 32 can be omitted. For example, if the cutting tool 33 is rotatable relative to the cutter base 32, instead of rotating the package holder 22 to align the cutter base 32 with an axial zone of the holder, the cutting tool 33 can be rotated relative to the cutter base 32 so that it can fit within adjacent containers 14. The controller system 40 can then move the cutter base 32 into position adjacent a selected container 14', rotate the cutting tool 33 into position, and proceed to cut the container 14' as usual. A similar process can be followed when dispensing the cut container 14' in order to make sure the cutting tool 33 is clear of any containers 14. In such an embodiment, prior to cutting the container 14, the cutting tool 33 can be rotated such that it cuts the container 14' at an angle.

Referring back to FIGS. 4 through 6, in some implementations a plurality of internal cameras (not shown) can be located along the dispensing path (displacement of the guide slide 36 and dispensing tray 38) to image the cut containers as they are dispensed. Furthermore, an internal camera 52 (see FIG. 4) typically images and captures all the data (including information such as patient name, bar codes and any other required information) typically located on the top header 13 of each package 12 (see FIG. 3 more specifically) and stores this information locally and securely in the cloud computing or the like.

Furthermore, in some embodiments the controller system 40 may be connected to a display 54, such as a large interactive touch screen or the like, an external communication device (not shown), such as a port for wire or an antenna for wireless communication with an internet server to send and receive information (to and from a cloud for example), as well as a sound receiver/microphone (not shown) for sound communication, and a light device (not shown) for visual communication, and the like.

Obviously, although not illustrated herein, it would be obvious to anyone skilled in the art, without departing from the scope of the present invention, that, for example, the holder 22 could be generally planar (either curved or flat) and fixed relative to the chassis 20 and that the cutter base 32 could be displaced relative to the holder and the package 12 by two or three different motors along two or three respective axis or along two or three degrees of freedom. Inversely, the cutter base 32 could be fixed relative to the chassis 20, and the motors could displace the holder 22 and the package 12 relative to the chassis 20 and the cutter base 32.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

The invention claimed is:

1. A mechanism for dispensing pills in an individual container, the individual container being one of a plurality of individual containers in an array-type pill package in which the individual containers are attached to one another in an arrangement of rows and columns and have a common top surface, the plurality of individual containers extending from the common top surface on a same side thereof, said mechanism comprising:

a chassis;

a package holder supported by the chassis for supporting the array-type pill package;

a cutting mechanism supported by the chassis and configured to cut a sidewall of the individual container adjacent the common top surface in order to separate the individual container from the array-type pill package;

a dispensing mechanism supported by the chassis and configured to receive and dispense a cut individual container therein; and a control system operatively connected to at least one of the package holder and the cutting mechanism, the control system being configured to control a relative position of the cutting mechanism and the package holder along at least two degrees of freedom;

wherein the package holder and the cutting mechanism are movably mounted to the chassis and the control system is configured to control the relative position of the package holder and the cutting mechanism along a first of the at least two degrees of freedom by displacing the package, and along a second line of the at least two degrees of freedom by displacing the cutting mechanism;

wherein the control system comprises a first motor configured to displace the package holder along the first degree of freedom, and a second motor configured to displace the cutting mechanism along the second degree of freedom; and wherein the package holder has a cylindrical shape with a periphery and a longitudinal axis, the first motor being configured to rotate the package holder about the longitudinal axis, and the second motor being configured to actuate the cutting mechanism in a plane generally tangent to the periphery of the package holder.

2. The mechanism according to claim 1, wherein the periphery of the package holder comprises an axial zone without any individual containers, said axial zone being sized to allow the cutting mechanism to displace therealong without contacting any of the individual containers.

3. The mechanism of claim 1, wherein the second motor is configured to actuate the cutting mechanism along a displacement axis in the plane generally tangent to the periphery of the package holder, the displacement axis being generally parallel to the longitudinal axis of the package holder.

4. The mechanism according to claim 3, wherein the dispensing mechanism comprises a guiding slide and a dispensing tray, the guiding slide being configured to receive the cut individual container and displace it towards the dispensing tray.

5. The mechanism according to claim 4, wherein the guiding slide and dispensing tray are operatively connected to the cutting mechanism and displaceable therewith along the displacement axis.

6. A cutting mechanism for opening and releasing a selected individual container from an array-type pill package, the individual container being one of a plurality of individual containers in the array-type pill package attached to one another and having a common top surface, the plurality of individual containers extending from the common top surface on a same side thereof, the array-type package being mounted onto a package holder supported by a chassis, said cutting mechanism comprising:

a cutter base movably mounted to the chassis and displaceable relative to the package holder;

a cutting tool mounted to the cutting base, the cutting tool being adapted for cutting a side wall of the selected individual container adjacent the common top surface to entirely detach the predetermined individual container from the array-type package;

a cutter motor operatively connected to the cutter base configured to displace the cutting tool in a plane generally tangent to the package holder;

a controller system configured to control a displacement of the cutting tool relative to the package holder along a displacement axis in the plane generally tangent to the package holder; and a worm screw operatively connected to the cutter motor and meshing with a threaded bore extending through the cutter base, the worm screw extending along the displacement axis.

7. The cutting mechanism according to claim 6, further comprising a cutter guide mounted to the chassis and generally parallel to the worm screw, the cutter guide slidably guiding the cutter base therealong.

8. The cutting mechanism according to claim 6, wherein the controller system comprises limit switches defining first and second end positions of the cutter base along the displacement axis.

9. The cutting mechanism according to claim 6, wherein the cutter base comprises a dispensing tray below the cutting tool, the dispensing tray being configured to receive the selected individual container after being cut from the array-type package.

10. The cutting mechanism according to claim 6, wherein the cutting tool comprises a cutting blade extending transversely relative to the displacement axis.

11. The cutting mechanism according to claim 10, wherein the cutting tool has a transverse length chosen such that the cutting blade simultaneously intersects with opposite side walls of the selected individual container upon displacement of the cutting tool along the displacement axis.

12. The cutting mechanism according to claim 10, wherein the cutting blade has a width chosen such that the cutting blade fits within a smallest space between two adjacent individual containers in the array-type pill package.

13. The cutting mechanism according to claim 10, wherein the cutting tool is rotatable relative to the cutter base.

14. The cutting mechanism according to claim 10, further comprising a cutter vibration motor operatively connected to the cutter base configured to vibrate the cutting blade transversely.

15. A method for dispensing pills from a selected individual container of a plurality of individual containers of an array-type pill package, the individual containers being attached to one another in an arrangement of rows and columns and having a common top surface, the array-type pill package being mounted in a dispensing system comprising a chassis, a cylindrical package holder mounted on the chassis rotatably about a longitudinal axis thereof and holding the array-type pill package thereon with the individual containers projecting radially away from said cylindrical package holder, and a cutting mechanism movably mounted to the chassis and displaceable along a displacement axis tangent to the cylindrical package holder, the method comprising the steps of:

a) rotating the package holder to align an axial zone of the package holder without any individual containers with the cutting mechanism;

b) positioning the cutting mechanism along the displacement axis between a column or row of individual containers adjacent the selected container;

c) rotating the package holder to position the cutting mechanism adjacent the selected container;

d) actuating the cutting mechanism along the displacement axis so as to cut through the sidewalls of the selected container;

e) receiving the cut selected container in a dispensing tray connected to the cutting mechanism;

f) positioning the cutting mechanism along the displacement axis between a second column or row of individual containers;

g) rotating the package holder to align the axial zone of the package holder without any individual containers with the cutting mechanism; and h) actuating the cutting mechanism to displace the dispensing tray to an exterior of the chassis, thereby dispensing the pills while inside the selected individual container.

* * * * *